US008926894B2

(12) United States Patent
Kågström et al.

(10) Patent No.: US 8,926,894 B2
(45) Date of Patent: Jan. 6, 2015

(54) METALLURGICAL FURNACE

(75) Inventors: Per Kågström, Skelleftea (SE); Lars Lundin, Skelleftea (SE); Sam Marklund, Skelleftea (SE)

(73) Assignee: Outotec Oyj, Espoo (FI)

( * ) Notice: Subject to any disclaimer, the term of this patent is extended or adjusted under 35 U.S.C. 154(b) by 292 days.

(21) Appl. No.: 13/517,042

(22) PCT Filed: Dec. 22, 2010

(86) PCT No.: PCT/FI2010/051074
§ 371 (c)(1),
(2), (4) Date: Jun. 18, 2012

(87) PCT Pub. No.: WO2011/077009
PCT Pub. Date: Jun. 30, 2011

(65) Prior Publication Data

US 2012/0256360 A1 Oct. 11, 2012

(30) Foreign Application Priority Data

Dec. 22, 2009 (FI) ..... 20096386

(51) Int. Cl.

| | |
|---|---|
| ***C21C 5/50*** | (2006.01) |
| ***F27B 7/12*** | (2006.01) |
| ***C21C 5/46*** | (2006.01) |
| ***F27B 7/26*** | (2006.01) |

(52) U.S. Cl.
CPC . *F27B 7/12* (2013.01); *C21C 5/464* (2013.01); *C21C 5/50* (2013.01); *F27B 7/26* (2013.01)
USPC ..... 266/247; 266/246

(58) Field of Classification Search
CPC ..... C21C 5/464; C21C 5/50
USPC ..... 266/246, 247, 248
See application file for complete search history.

(56) References Cited

U.S. PATENT DOCUMENTS 3,381,951 A 5/1968 Gaines
3,838,849 A 10/1974 Alexander (Continued)

FOREIGN PATENT DOCUMENTS

CN 1134645 C 1/2004
CN 1844818 A 10/2006

(Continued)

OTHER PUBLICATIONS

Marko Keranen, International Search Report for PCT/FI2010/051074, Mar. 29, 2011.
Teppo Falt, Finnish Search Report for FI 20096386, Oct. 26, 2010.
Chinese Office Action issued Dec. 9, 2013 including Chinese Search Report for Chinese Application No. 201080058359.4 (with English translation), 11 pages.

*Primary Examiner* — Scott Kastler
(74) *Attorney, Agent, or Firm* — Chernoff, Vilhauer, McClung & Stenzel, LLP

(57) ABSTRACT

The invention relates to a metallurgical furnace, comprising a furnace body (1), a trunnion ring (2), and a pedestal structure (3). The furnace body (1) is arranged in the trunnion ring (2) rotatably about a rotation axis (A) by means of a supporting arrangement (4) comprising a bearing arrangement (5) between the trunnion ring (2) and the furnace body (1). The supporting arrangement (4) comprises a first connection frame means (7) between the furnace body (1) and the bearing arrangement (5), and a second connection frame means (8) between the bearing arrangement (5) and the trunnion ring (2). The second connection frame means (8) is connected to the trunnion ring (2) by a first attachment (9) providing for movements between the second connection frame means (8) and the trunnion ring (2).

13 Claims, 6 Drawing Sheets

(56) References Cited

U.S. PATENT DOCUMENTS

| | | | | |
|---|---|---|---|---|
| 4,055,335 | A | 10/1977 | Fisher | |
| 4,385,748 | A | 5/1983 | Murakami | |
| 6,060,015 | A | 5/2000 | Kagstrom et al. | |
| 2012/0256360 | A1 * | 10/2012 | Kagstrom et al. | 266/248 |

FOREIGN PATENT DOCUMENTS

| | | | |
|---|---|---|---|
| EP | 0887607 | | 12/1998 |
| EP | 1533389 | A1 | 5/2005 |
| JP | 2002005300 | | 1/2002 |
| JP | 2002005300 | A | 1/2002 |

* cited by examiner

METALLURGICAL FURNACE

CROSS-REFERENCE TO RELATED APPLICATIONS

This is a national stage application filed under 35 USC 371 based on International Application No. PCT/FI2010/051074 filed Dec. 22, 2010, and claims priority under 35 USC 119 of Finnish Patent Application No. FI 20096386 filed Dec. 22, 2009.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Not Applicable.

FIELD OF THE INVENTION

By a metallurgical furnace is here generally meant a metallurgical furnace unit comprising a furnace vessel and auxiliary equipment for supporting, turning and tilting of the furnace vessel of the metallurgical furnace unit. Such a metallurgical furnace unit is for example presented in publication U.S. Pat. No. 3,838,849. The auxiliary equipment for supporting, turning and tilting of the furnace vessel in this previously known metallurgical furnace unit comprises a trunnion ring in which the furnace vessel is arranged and supported by means of a connection structure arranged between the furnace vessel and the trunnion ring. The connection structure comprising a bearing arrangement for providing for said rotating movement of the furnace vessel in relation to the trunnion ring about a rotation axis. The auxiliary equipment for supporting, turning and tilting of the rotatable and tiltable furnace vessel of the metallurgical furnace unit of this previously known metallurgical furnace unit comprises additionally a pedestal structure to which the trunnion ring is connected by means of a pair of diametrically arranged horizontal trunnion pins for providing for said tilting movement of said furnace vessel about a horizontal tilting axis.

One problem with the metallurgical furnace presented in publication U.S. Pat. No. 3,838,849 is the bearing arrangement between the furnace body and the trunnion ring. In publication U.S. Pat. No. 3,838,849 the bearing arrangement is a slewing bearing which means that the bearing arrangement comprises a first annular bearing means secured to the trunnion ring, a second annular bearing means secured to the furnace vessel and surrounding the furnace vessel, a set of radial thrust bearings interposed between said first and second annular bearing means, and at least one set of axial thrust bearings interposed between said first and second annular bearing means for bearing the load of said vessel. A bearing arrangement of this type is difficult to adjust due to its complicated structure. Such a complicated bearing arrangement also has a considerable need for maintenance. Also thermal expansion of the furnace body puts considerable stress on the bearing arrangement which contributes to considerable wear of the bearing arrangement. It can furthermore in this context be generally said about slewing bearing arrangements of this type that they have a moderate axial stiffness and that the diameter is large compared to the cross section. A slewing bearing arrangement of this type has to be mounted in a sufficient bending-stiff and torsion-stiff companion structure so that the sides i.e. the annular bearing means of the slewing bearing cannot be displaced in relation to each other, but also a structure that is flexible in the meaning that both sides of the slewing bearing is allowed to "follow" each other is possible so that there will be no local spots with considerably higher local loads on the rollers between the sides.

DESCRIPTION OF RELATED ART INCLUDING INFORMATION DISCLOSED UNDER 37 CFR 1.97 AND 1.98

Not Applicable.

OBJECTIVE OF THE INVENTION

The object of the invention is to provide a metallurgical furnace having a new and innovative supporting arrangement between the trunnion ring and the furnace body for connecting the trunnion ring and the furnace body that solves the above-identified problem with the bearing arrangement of the supporting arrangement of the metallurgical furnace presented in U.S. Pat. No. 3,838,849 but which also can be used in connection with such metallurgical furnaces having bearing arrangements comprising other types of bearings than slewing bearings.

BRIEF SUMMARY OF THE INVENTION

The invention is based on using between the furnace body and the trunnion ring a supporting arrangement comprising a first connection frame means and a second connection frame means and on connecting the first connection frame means to the furnace body and to the bearing arrangement and on connecting the second connection frame means to the bearing arrangement and to the trunnion ring so that the second connection frame means is connected to the trunnion ring by a first attachment providing for movements between the second connection frame means and the trunnion ring. By doing this, the supporting arrangement that is connected to the furnace body is allowed to move in relation to the trunnion ring for example as a result of thermal expansion of the furnace body at the same time as the bearing arrangement is not affected by such thermal expansion. In other words, the first attachment provides for a floating connection between the supporting arrangement and the trunnion ring. In other words, the floating connection between the supporting arrangement and the trunnion ring by means of the first attachment allows the rotating side and the stationary side of the bearing arrangement to follow each other, because the first connection frame means, which the rotating side of the bearing arrangement means is secured to, can follow the second connection frame means to which the stationary side of the bearing arrangement is secured.

In a preferred embodiment of the invention the first connection frame means between the furnace body and the bearing arrangement comprises a closed mantle which surrounds the furnace body and which is connected to the furnace body by a second attachment providing for movements between the bearing arrangement and the furnace body caused by thermal expansion of the furnace body. Such a closed mantle may have at least partly a cylindrical or conical configuration. Such an arrangement is presented in document EP 0 887 607.

In a preferred embodiment of the invention the bearing arrangement of the supporting arrangement between the furnace body and the trunnion ring comprises a slewing bearing that surrounds the furnace body and that comprises a first annular bearing means secured to the first connection frame means and a second annular bearing means secured to the second connection frame means, and a set of radial thrust bearings interposed between the first annular bearing means and the second annular bearing means, and a set of axial thrust bearings interposed between the first annular bearing means and the second annular bearing means for bearing the load of the furnace body and for bearing the load of the furnace charge. In such an embodiment the invention provided for such a flexible structure that the first annular bearing means secured to the first connection frame means and the second annular bearing means secured to the second connection frame means can "follow" each other so that possible local spots with higher load on the radial trust bearings and annular trust bearings between the first annular bearing means and the second annular bearing means can be reduced or even eliminated. In other words, the floating connection between the supporting arrangement and the trunnion ring by means of the first attachment allows the first annular bearing means and the second annular bearing means of the bearing arrangement to follow each other because the first connection frame means, which the first annular bearing means is secured to, can follow the second connection frame means to which the second annular bearing means is secured.

In a preferred embodiment of the invention the second connection frame means has preferably an essentially circular outer configuration and the trunnion ring has preferably a corresponding essentially circular inner configuration. In this preferred embodiment of the invention the outer diameter of the second connection frame means is smaller than the inner diameter of the trunnion and the second connection frame means is surrounded by the trunnion ring so that there is a gap between an inner surface of the trunnion ring and an outer surface of the second connection frame means so as to allow thermal expansion of the second connection frame means in relation of the trunnion ring.

BRIEF DESCRIPTION OF THE SEVERAL VIEWS OF THE DRAWINGS

In the following the invention will be described in more detail by referring to the figures, of which

DETAILED DESCRIPTION OF THE INVENTION

Figure 1:
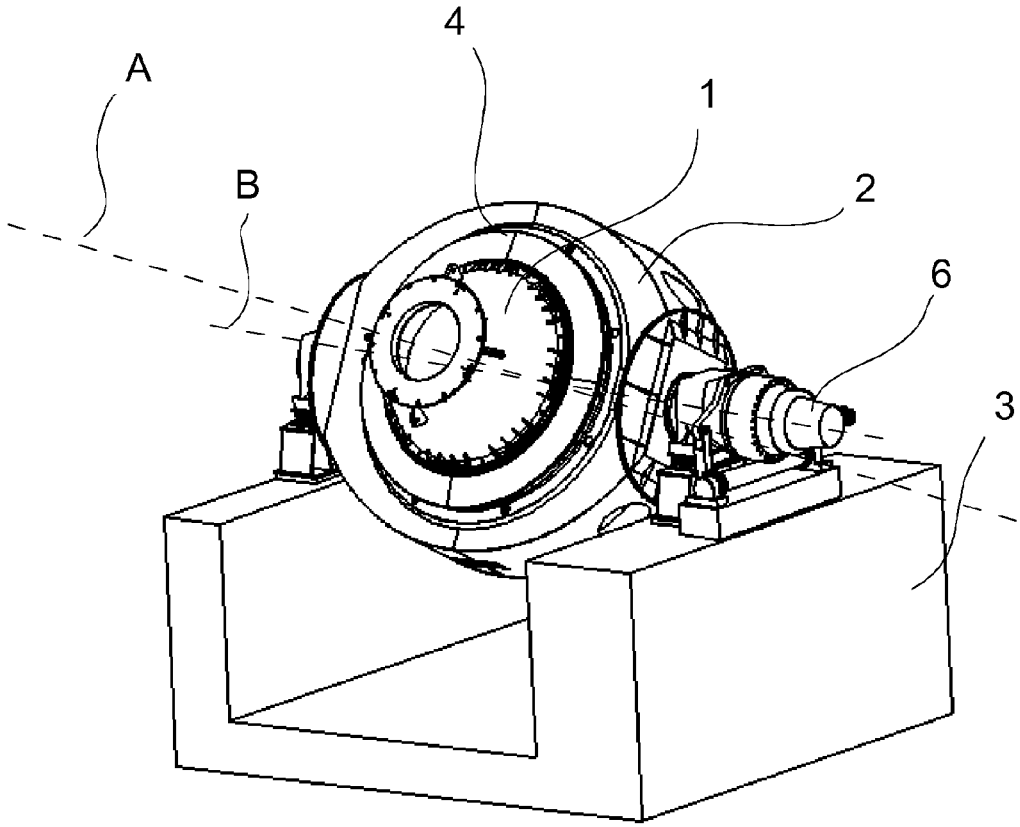
FIG. 1 shows a metallurgical furnace according to a preferred embodiment of the invention.

FIG. 1 shows a preferred embodiment of a metallurgical furnace according to the invention.

The metallurgical furnace shown in FIG. 1 comprises a furnace body 1, a trunnion ring 2, and a pedestal structure 3.

The furnace body 1 is arranged for rotating movement in the trunnion ring 2 about a rotation axis A by means of a supporting arrangement 4 between the trunnion ring 2 and the furnace body 1 for connecting the trunnion ring 2 and the furnace body 1. The supporting arrangement 4 comprises a bearing arrangement 5 between the trunnion ring 2 and the furnace body 1 for allowing for said rotating movement.

The trunnion ring 2 is pivotably connected to the support structure for tilting movement of the furnace body 1 about a pivoting axis. In FIG. 1 the trunnion ring 2 is pivotably connected to the support structure by means of a pair of diametrically opposed trunnion pins 6 for tilting movement of the furnace body 1 about a horizontal pivoting axis B.

The supporting arrangement 4 comprises a first connection frame means 7 between the furnace body 1 and the bearing arrangement 5, and a second connection frame means 8 between the bearing arrangement 5 and the trunnion ring 2.

The first connection frame means 7 and the second connection frame means 8 surround the furnace body 1.

The first connection frame means 7 is connected to the furnace body 1 and to the bearing arrangement 5.

The second connection frame means 8 is connected to the bearing arrangement 5 and to the trunnion ring 2 so that the second connection frame means 8 is connected to the trunnion ring 2 by a first attachment 9 providing for movements between the second connection frame means 8 and the trunnion ring 2.

The first connection frame means 7 between the furnace body 1 and the bearing arrangement 5 may comprise a closed mantle 10 which surrounds the furnace body 1 and which is connected to the furnace body 1 by a second attachment 11 providing for movements between the closed mantle 10 and the furnace body 1 caused by thermal expansion of the furnace body 1. Such a possible closed mantle 10 may have at least partly a cylindrical or conical configuration. Such an arrangement is presented in document EP 0 887 607.

Figure 6:
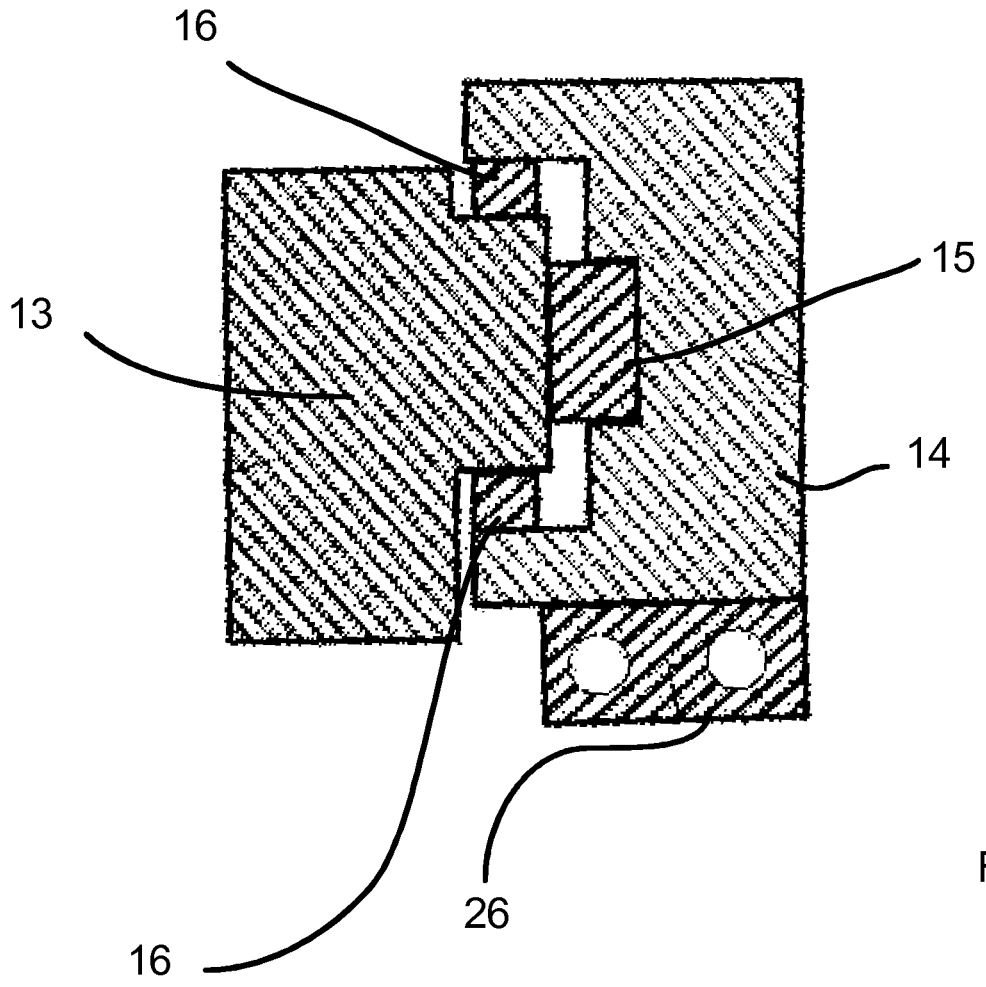
FIG. 6 shows a detail view of slewing bearing where the first annular bearing means is provided with a first cooling system.

The bearing arrangement 5 of the supporting arrangement 4 between the furnace body 1 and the trunnion ring 2 comprises preferably as shown in the figures, but not necessarily, a slewing bearing 12 that surrounds the furnace body 1. The slewing bearing 12 shown in the figures, see especially FIG. 6, comprises a first annular bearing means 13 secured to the first connection frame means 7 and a second annular bearing means 14 secured to the second connection frame means 8, and at least one set of radial thrust bearings 15 interposed between the first annular bearing means 13 and the second annular bearing means 14, and at least one set of axial thrust bearings 16 interposed between the first annular bearing means 13 and the second annular bearing means 14 for bearing the load of the furnace body 1 and for bearing the load of the furnace charge. The first annular bearing means 13 may, as shown in FIG. 6, be provided with a first cooling system (not shown in the figures) for transporting thermal energy from the first annular bearing means 13 with a cooling fluid circulating in the first cooling system. The second annular bearing means 14 may be provided with a second cooling system 26 for transporting thermal energy from the second annular bearing means 14 with a cooling fluid circulating in the second cooling system. Additionally or alternatively both the first annular bearing means 13 and the second annular bearing means 14 may be air cooled.

Figure 2:
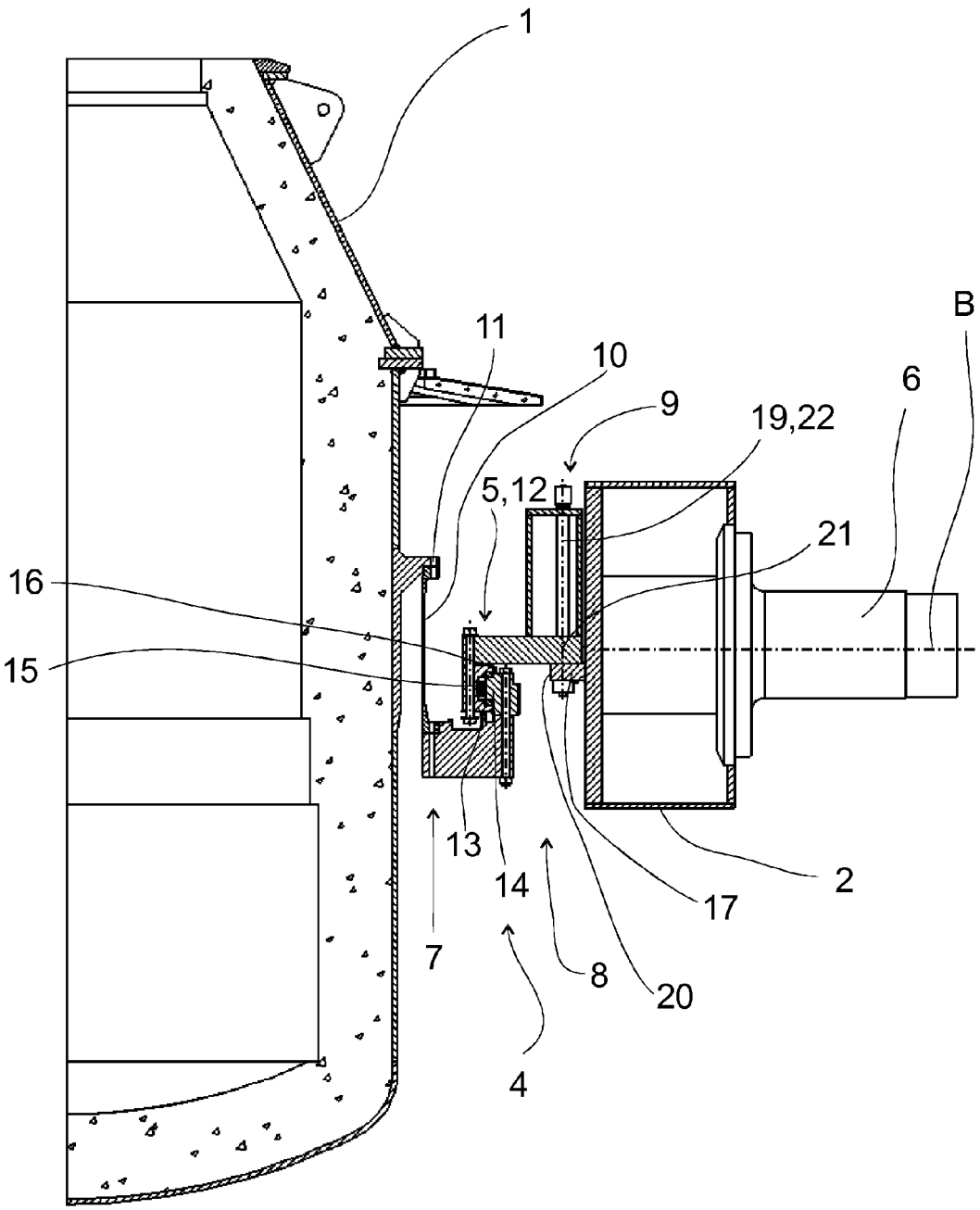
FIG. 2 shows in cut view a detail of the metallurgical furnace shown in FIG. 1.

In FIG. 2 the first attachment 9 comprises a flange means 17 projecting from an inner surface 23 of the trunnion ring 2 for supporting the second connection frame means 8 within the trunnion ring 2 in the axial direction of the furnace body 1. The flange means 17 is preferably situated under the trunnion ring 2 in the normal working position of the metallurgical furnace so that the flange means 17 can bear the load of the furnace body 1 and bear the load of the furnace charge.

Figure 3:
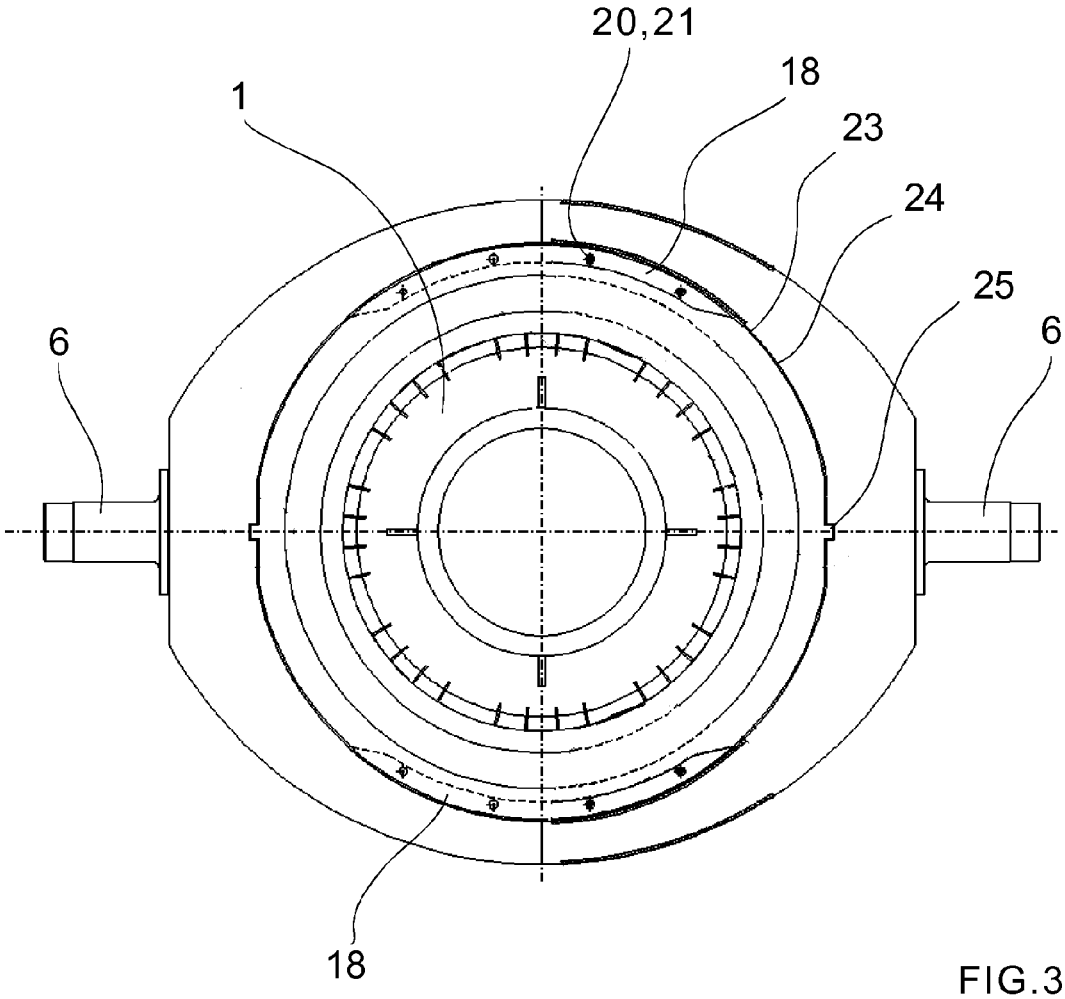
FIG. 3 shows from above the metallurgical furnace shown in FIG. 1 without the support structure.
Figure 4:
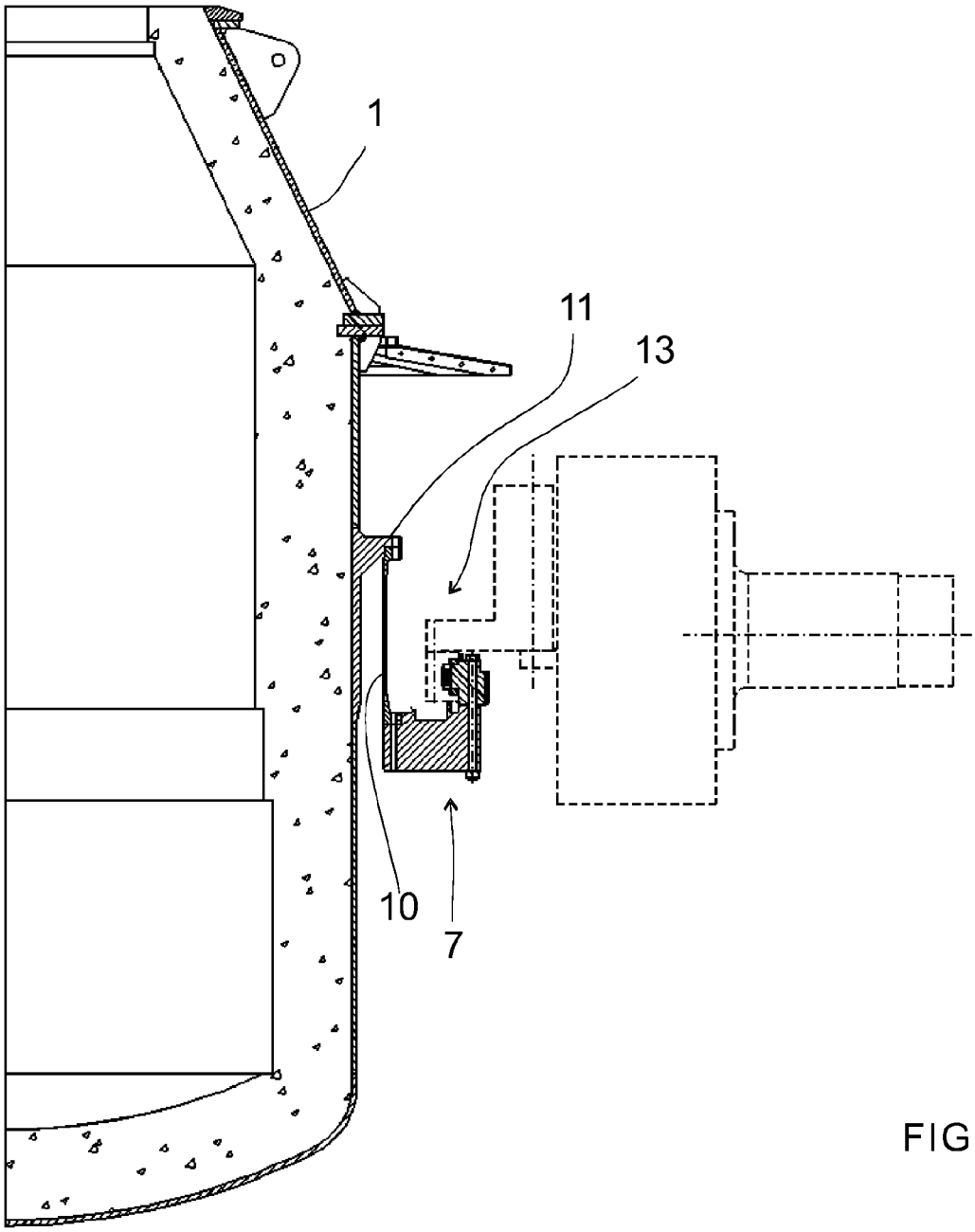
FIG. 4 shows the parts of the detail view shown in FIG. 2, which in FIG. 2 are fastened to the furnace body for rotation with the furnace body.
Figure 5:
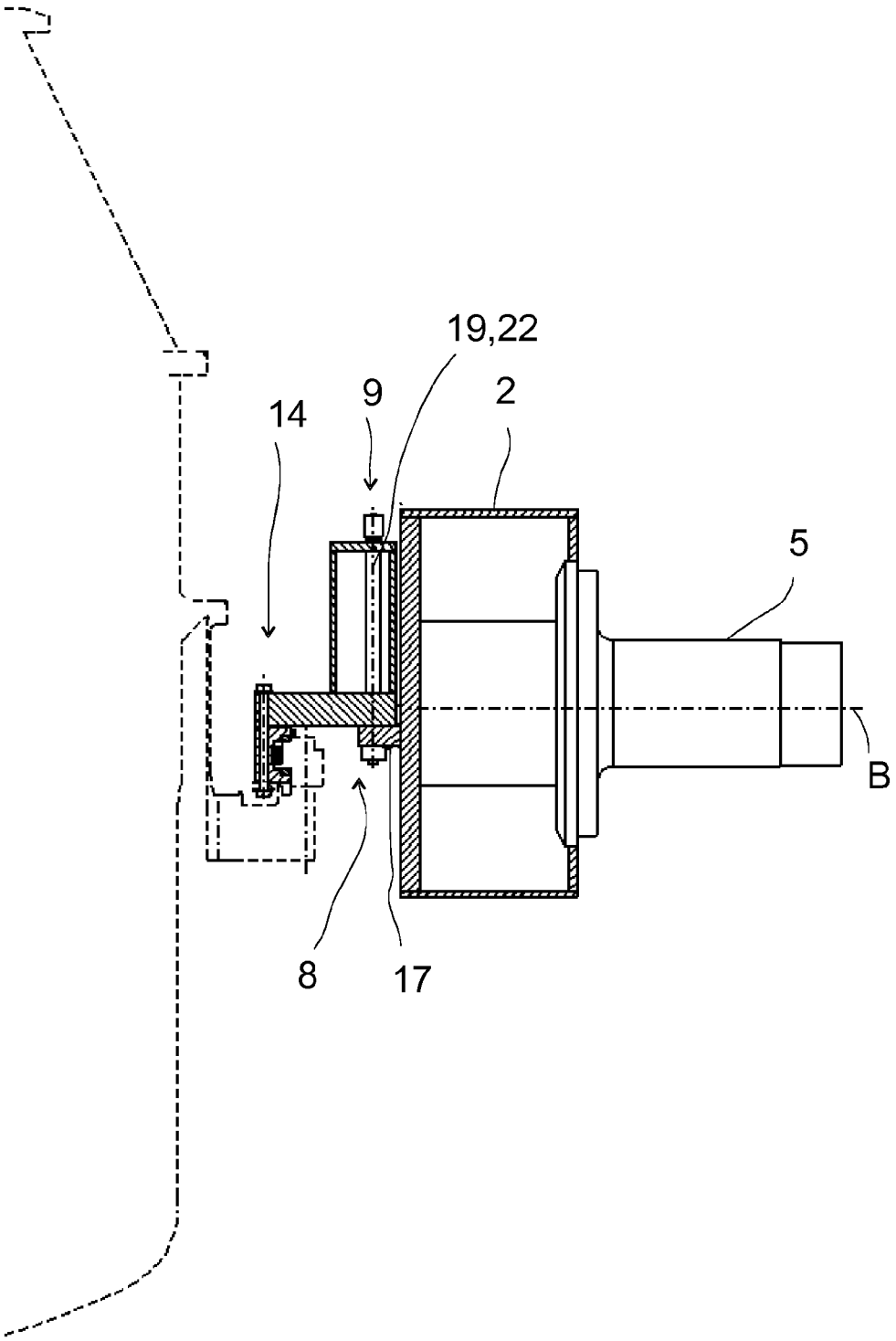
FIG. 5 shows the parts of the detail view shown in FIG. 2, which in FIG. 2 are fastened to the trunnion ring.

The flange means 17 is preferably as shown in FIG. 3, but not necessarily, divided into several flange sections 18 so that the second connection frame means 8 is unsupported within the trunnion ring 2 between two flange sections 18 in the axial direction of the furnace body 1. The arrangement shown in FIG. 3 comprises two flange sections 18 which are symmetrically arranged at an inner surface 23 of the trunnion ring 2 with respect to the pivoting axis so that the second connection frame means 8 is unsupported within the trunnion ring 2 between two flange sections 18 in the axial direction of the furnace body 1 at the pivoting axis. One reason for dividing the flange means 17 into several flange sections 18 is to provide for some axial movement between the trunnion ring 2 and the furnace body 1 for example due to own weight when tilting the furnace body 1 about the horizontal pivoting axis B. Because the second connection frame means 8 is unsupported within the trunnion ring 2 between two flange sections 18 in the axial direction of the furnace body 1, local high local load spots between the second connection frame means 8 and the flange means 17 will be eliminated, because the trunnion ring 2, to which the flange sections 18 are fastened, is for example allowed to bend about the horizontal pivoting axis B due to thermal expansion without such bending movement affecting the second connection frame means.

The arrangement shown in FIG. 2 comprises fastening means 19 for fastening the second connection frame means 8 to the flange means 17 of the trunnion ring 2 so as to permit movement between the second connection frame means 8 and the trunnion ring 2 in the radial direction of the furnace body 1, and so as to prevent movement between the second connection frame means 8 and the trunnion ring 2 in the axial direction of the furnace body 1. For example in a situation where the furnace body 1 is turned about the pivoting axis upside-down, the fastening means 19 are in the arrangement shown in FIG. 2 configured to hold the second connection frame means 8 connected to the flange means 17 of the trunnion ring 2.

In an arrangement as the one shown in FIG. 2, the flange means 17 can for example be provided with first holes 20 and the second connection frame means 8 can be provided with second holes 21 co-operating with the first holes 20 so that a fastening means 19 in the form of an external fastening device 22 such as a bolt can project at least partly through at least one first hole 20 in the flange means 17 and at least partly through at least one second hole 21 in the second connection frame means 8. The external fastening device 22 fastening the second connection frame means 8 to the flange means 17 can be configured so that axial movement between the second connection frame means 8 and the flange in the axial direction of the furnace body 1 is prevented but so that radial movement in the radial direction of the furnace body 1 between the second connection frame means 8 and the flange is possible. Such an arrangement is possible in the arrangement shown in FIG. 2 for example by making the diameter of the second holes 21 in the second connection frame means 8 larger than the diameter of the bolt so that the bolt can move in relation to the second hole 21.

The trunnion ring 2 may comprise an inner surface 23 facing an outer surface 24 of the second connection frame means 8, wherein at least one of the inner surface 23 and the outer surface 24 comprising at least one guide means 25 projecting into the other of the inner surface 23 and the outer surface 24 carrying load for preventing the trunnion ring 2 and the second connection frame means 8 from rotating with respect to each other. In FIG. 3 the inner surface 23 of the trunnion ring 2 is provided with cut-outs into which projections formed on the outer surface 24 of the second connection frame means 8 project.

The second connection frame means 8 has preferably an essentially circular outer configuration and the trunnion ring 2 has preferably a corresponding essentially circular inner configuration so that the outer diameter of the second connection frame means 8 is smaller than the inner diameter of the trunnion ring 2 so that there is a gap between an inner surface 23 of the trunnion ring 2 and an outer surface 24 of the second connection frame means 8 so as to allow thermal expansion of the second connection frame means 8 in relation of the trunnion ring 2.

The second connection frame means 8 can alternatively have an essentially oval outer configuration and the trunnion ring 2 has preferably a corresponding, but smaller, essentially oval inner configuration so that there is a gap between an inner surface 23 of the trunnion ring 2 and an outer surface 24 of the second connection frame means 8 so as to allow thermal expansion of the second connection frame means 8 in relation of the trunnion ring 2. It is clear to a person skilled in the art that other forms than circular and oval are possible.

It is apparent to a person skilled in the art that as technology advances, the basic idea of the invention can be implemented in various ways. The invention and its embodiments are therefore not restricted to the above examples, but they may vary within the scope of the claims.

Sequence Listing

Not Applicable.

The invention claimed is:

1. A metallurgical furnace, comprising a furnace body, a trunnion ring, and a pedestal structure, wherein the furnace body is arranged for rotating movement in the trunnion ring about a rotation axis by means of a supporting arrangement between the trunnion ring and the furnace body for connecting the trunnion ring and the furnace body, wherein said supporting arrangement comprising a bearing arrangement between the trunnion ring and the furnace body for allowing for said rotating movement, and wherein the trunnion ring is pivotably connected to the pedestal structure for tilting movement of the furnace body about a horizontal pivoting axis, the supporting arrangement comprises a first connection frame means between the furnace body and the bearing arrangement, and a second connection frame means between the bearing arrangement and the trunnion ring, wherein the first connection frame means and the second connection frame means surround the furnace body, the first connection frame means is connected to the furnace body and to the bearing arrangement, the second connection frame means is connected to the bearing arrangement and to the trunnion ring, and the second connection frame is connected to the trunnion ring by a first attachment (9) providing for movements between the second connection frame means and the trunnion ring.

2. The metallurgical furnace according to claim 1, wherein the first connection frame means comprises a closed mantle which surrounds the furnace body and which is connected to the furnace body by a second attachment providing for movements between the bearing arrangement and the furnace body caused by thermal expansion of the furnace body.

3. The metallurgical furnace according to claim 1, wherein the bearing arrangement comprises a slewing bearing that surrounds the furnace body, and the slewing bearing comprises a first annular bearing means secured to the first connection frame means and a second annular bearing means secured to the second connection frame means, and at least one set of radial thrust bearings interposed between the first annular bearing means and the second annular bearing means, and at least one set of axial thrust bearings interposed between the first annular bearing means and the second annular bearing means for bearing the load of the furnace body and for bearing the load of the furnace charge.

4. The metallurgical furnace according to claim 3, wherein the first annular bearing means is provided with a first cooling system for transporting thermal energy from the first annular bearing means with a cooling fluid circulating in the first cooling system.

5. The metallurgical furnace according to claim 3, wherein the second annular bearing means is provided with a second cooling system for transporting thermal energy from the second annular bearing means with a cooling fluid circulating in the second cooling system.

6. The metallurgical furnace according to claim 1, wherein the first attachment comprises a flange means projecting from an inner surface of the trunnion ring for supporting the second connection frame means within the trunnion ring in the axial direction of the furnace body.

7. The metallurgical furnace according to claim 6, wherein the flange means is divided into several flange sections so that the second connection frame means is unsupported within the trunnion ring between two flange sections in the axial direction of the furnace body.

8. The metallurgical furnace according to claim 7, wherein flange means comprises two flange sections which are symmetrically arranged at an inner surface of the trunnion ring with respect to the pivoting axis so that the second connection frame means is unsupported within the trunnion ring between two flange sections in the axial direction of the furnace body at the pivoting axis.

9. The metallurgical furnace according to claim 6, wherein fastening means for fastening the second connection frame means to the flange means of the trunnion ring is provided so as to permit movement between the second connection frame means and the trunnion ring in the radial direction of the furnace body, and so as to prevent movement between the second connection frame means and the trunnion ring in the axial direction of the furnace body.

10. The metallurgical furnace according to claim 9, wherein the flange means is provided with first holes and the second connection frame means is provided with second holes co-operating with the first holes so that an external fastening device such as a bolt projects at least partly through at least one first hole in the flange means and at least partly through at least one second hole in the second connection frame means, whereby said external fastening device fastening the second connection frame means to the flange means so that axial movement between the second connection frame means and the flange means in the axial direction of the furnace body is prevented but so that radial movement in the radial direction of the furnace body between the second connection frame means and the flange means is possible.

11. The metallurgical furnace according to claim 1, wherein the trunnion ring comprises an inner surface facing an outer surface of the second connection frame means, and there is a gap between the inner surface of the trunnion ring and the outer surface of the second connection frame means so as to allow thermal expansion of the second connection frame means in relation to the trunnion ring.

12. The metallurgical furnace according to claim 1, wherein the outer surface of the second connection frame means has an essentially circular configuration, the inner surface of the trunnion ring has a corresponding essentially circular configuration, the outer diameter of the second connection frame means is smaller than the inner diameter of the trunnion ring so that there is a gap between the inner surface of the trunnion ring and the outer surface of the second connection frame means so as to allow thermal expansion of the second connection frame means in relation of the trunnion ring.

13. The metallurgical furnace according to claim 1, wherein the trunnion ring comprises an inner surface facing an outer surface of the second connection frame means, wherein at least one of the inner surface and the outer surface comprising at least one guide means projecting into the other of the inner surface and the outer surface for carrying load and preventing the trunnion ring and the second connection frame means from rotating with respect to each other.

* * * * *